US011549406B2

(12) United States Patent
Fawley

(10) Patent No.: US 11,549,406 B2
(45) Date of Patent: Jan. 10, 2023

(54) VALVE CLEARANCE SETTING AND ADJUSTMENT COMPONENTS AND SYSTEMS AND METHODS OF USING THE SAME

(71) Applicant: R. Bradford Fawley, Guilford, VT (US)

(72) Inventor: R. Bradford Fawley, Guilford, VT (US)

( * ) Notice: Subject to any disclaimer, the term of this patent is extended or adjusted under 35 U.S.C. 154(b) by 0 days.

(21) Appl. No.: 17/594,339

(22) PCT Filed: May 7, 2020

(86) PCT No.: PCT/US2020/031810
§ 371 (c)(1),
(2) Date: Oct. 12, 2021

(87) PCT Pub. No.: WO2020/227490
PCT Pub. Date: Nov. 12, 2020

(65) Prior Publication Data

US 2022/0186638 A1 Jun. 16, 2022

Related U.S. Application Data

(60) Provisional application No. 62/845,629, filed on May 9, 2019.

(51) Int. Cl.
*F01L 1/20* (2006.01)
*F01L 1/18* (2006.01)

(52) U.S. Cl.
CPC ..... *F01L 1/20* (2013.01); *F01L 1/181* (2013.01); *F01L 2303/01* (2020.05)

(58) Field of Classification Search
CPC ..... F01L 1/181; F01L 1/20; F01L 2303/01
(Continued)

(56) References Cited

U.S. PATENT DOCUMENTS

2012/0227695 A1* 9/2012 Bokura ..... F01L 1/146 123/90.16

FOREIGN PATENT DOCUMENTS

CN 2048897 U * 12/1989
CN 2048897 U 12/1989
(Continued)

OTHER PUBLICATIONS

Rob Siegel, "Valve Adjustment on BMW Single-Cam Engines." https://bimmerlife.com/2018/05/11/valve-adjustment-on-brnw-single-cam-engines (May 11, 2018).
(Continued)

*Primary Examiner* — Jorge L Leon, Jr.
(74) *Attorney, Agent, or Firm* — Downs Rachlin Martin PLLC

(57) ABSTRACT

Valve clearance adjustment systems and related methods that can be used to quickly and easily establish and accurately fix a desired and consistent and replicable valve clearance gap in internal combustion engines with shaft mounted rocker arms where a manual valve lash adjustment is required. In some examples, valve adjustment systems include valve adjustment members that are movably disposed in rocker arms and that can be easily and selectively fixed in place in the rocker arm. Aspects also include indexing mechanisms (734, 822, 838) for quickly and easily setting a desired position of a valve adjustment screw in a rocker arm without needing to use a feeler gauge.

20 Claims, 10 Drawing Sheets

(58) Field of Classification Search
USPC ..... 123/90.39, 90.45
See application file for complete search history.

(56) References Cited

FOREIGN PATENT DOCUMENTS

| | | | | | |
|---|---|---|---|---|---|
| CN | 103277161 | B | | 8/2015 | |
| DE | 454184 | C | | 1/1928 | |
| DE | 102016206959 | A1 | * | 10/2017 | |
| GB | 191177 | A | | 1/1923 | |
| GB | 448530 | A | * | 6/1936 | |
| GB | 530110 | A | | 12/1940 | |
| GB | 567711 | A | * | 2/1945 | |
| GB | 969987 | A | * | 9/1964 | |
| WO | 200078508 | A2 | | 12/2000 | |
| WO | 2016130664 | A1 | | 6/2016 | |
| WO | WO-2016130664 | A1 | * | 8/2016 | ..... F01L 1/181 |

OTHER PUBLICATIONS

International Search Report and Written Opinion dated Aug. 20, 2020, in corresponding International Application No. PCT/US2020/031810 filed on May 7, 2020.

* cited by examiner

VALVE CLEARANCE SETTING AND ADJUSTMENT COMPONENTS AND SYSTEMS AND METHODS OF USING THE SAME

RELATED APPLICATION DATA

This application claims the benefit of priority of U.S. Provisional Patent Application Ser. No. 62/845,629, filed May 9, 2019, and titled "Valve Clearance Setting and Adjustment Parts, Systems and Related Methods", which is incorporated by reference herein in its entirety.

FIELD OF THE INVENTION

The present invention generally relates to the field of valve clearance systems. In particular, the present invention is directed to valve clearance setting and adjustment components and systems and methods of using the same.

BACKGROUND

The cylinders of combustion engines include intake valves that allow a mixture of fuel and air into the cylinder and exhaust valves that allow spent gases to escape from the cylinder. Both types of valves are typically spring-loaded to a closed position and include a valve stem that extends from the cylinder. Depending on the type of engine, various mechanisms are used to periodically push on the valve stems at precise times to control the opening and closing of the valves. Engines with solid lifter configurations have a small gap between the pushing mechanism and the top of the valve stem, which may be referred to in the art as a valve gap, valve clearance gap, or lash clearance. The valve gap is required to prevent binding as the valve train components, particularly the valve stem, begin to expand as the engine heats up. The size of the valve gap is adjustable and is sometimes referred to in the art as a valve gap setting, tappet setting, or valve lash setting.

FIG. 1 shows a portion of an example prior art original equipment manufacturer (OEM) engine with a valve adjustment system 100 and includes a rocker arm 102 having a first end 104 and a second end (not illustrated). In the example shown in FIG. 1, the first end 104 includes a valve adjustment screw 106 that can be raised and lowered relative to the first end of the rocker arm to adjust a valve clearance gap 108 between an end 110 of the valve adjustment screw and an end 112 of a valve stem 114. A lock nut 116 can be tightened down to secure valve adjustment screw 106 at a desired position. The second end of the rocker arm is operably driven by a cam shaft (not illustrated), the camshaft raising and lowering the second end of the rocker arm, causing the rocker arm to pivot about a rocker arm shaft 118 and a corresponding raising and lowering of the first end 104 of the rocker arm. The valve train configuration illustrated in FIG. 1 is sometimes referred to in the art as a direct action solid lifter configuration. To adjust the valve clearance gap 108 to the correct size, a feeler gauge 120 having a thickness equal to the desired valve gap is positioned between the valve adjustment screw 106 and valve stem 114 and the valve adjustment screw is tightened until end 110 contacts the feeler gauge. The lock nut 116 is then tightened to secure the valve adjustment screw in place and the feeler gauge is removed.

FIG. 2 illustrates a prior art OEM valve adjustment system 200. In some engine configurations, such as the one shown in FIG. 2, the valve clearance adjustment procedure is accomplished by adjusting an adjusting screw 206 located in a threaded rocker arm bore 207 in a first end 204 of the rocker arm 202, the adjusting screw bears on a pushrod 217 on an opposing side of the rocker arm from a valve stem 214. The configuration shown in FIG. 2 is sometimes referred to in the art as a pushrod solid lifter. FIG. 2 shows a rocker arm 202 having a first end 204 and a second end 205. In the example shown in FIG. 2, the first end 204 includes a valve adjustment screw 206 that can be raised and lowered to adjust a valve clearance gap 208 on an opposite side of the rocker arm from the adjustment screw, the gap located between the second end 205 of the rocker arm and an end 212 of a valve stem 214. A lock nut 216 can be tightened down to secure adjustment screw 206 at a desired position. The first end 204 of the rocker arm is operably driven by a cam shaft (not illustrated) via pushrod 217, the camshaft converting a rotational motion of the camshaft into a linear motion of the pushrod 217, which in turn causes the pushrod 217 and first end 204 to raise and lower, causing the rocker arm to pivot about a rocker arm shaft 218 and a corresponding raising and lowering of the second end 205 of the rocker arm 202. To adjust the valve clearance gap 208 to the correct size, a feeler gauge (not illustrated) having a thickness equal to the desired valve gap is positioned between the second end 205 of the rocker arm 202 and valve stem 214 and the valve adjustment screw 206 is adjusted until second end 205 of rocker arm 202 contacts the feeler gauge. The lock nut 216 is then tightened to secure the valve adjustment screw in place and the feeler gauge is removed.

One example of a group of automobiles that include a direct action solid lifter configuration engine as shown in FIG. 1 are the 1965 to 1994 Porsche® 911 engines. On these pre-1995 Porsche® 911 engines, setting the valve clearance gap 108 and adjusting the valves is currently performed in several different ways and using several different tools, but always by turning the adjustment screws 106 located in the rocker arms 102 and, once the specified clearance is set, locking the screw down with locking nut 116. This process is very difficult to perform with the engine in the car given the small clearances for visibility and manipulation of tools around the engine parts and compartment. The process is still difficult to perform even with the engine out of the car because the tolerances for the adjustment are very small. For example, in the aforementioned Porsche® 911 engines, the valve clearance gap between the end 110, which may be an end of a swivel foot, of the adjustment screw 106 and the end 112 of the valve stem 114 is specified by the manufacturer at 0.10 mm.

Further, because there are two valve clearance adjustments (an intake and an exhaust) for each of the 911's six cylinders, the process must be repeated 12 times. Even then, because the known procedures are not simple or accurate, it is typically recommended that all clearances be checked twice or even three times before completing the valve clearance adjustment process. The entire process can take several hours for a skilled mechanic and up to two days or more for an unskilled mechanic. Even then, because the process requires human "feel" for the valve clearance gap at issue and the turning of the lockdown nut without movement of the adjustment screw, the actual results obtained can be questionable—even for a skilled mechanic familiar with these types of engines.

For example, with respect to the 911 engine, there are several different known methods of adjusting the valve clearance. Most employ the factory OEM type adjustment screw 106 and a lock nut 116 as depicted in FIG. 1. Traditional methods of valve adjustment are well-described in other publications and the original factory manuals for the engines described. For the 911 engine, the factory method involves loosening lock nut 116 and slipping a 0.10 mm feeler gauge 120 into the very small space between the end 110 of adjustment screw 106 and the end 112 of valve stem 114. Once in place, the adjustment screw 106 is turned until the feeler gauge 120 can barely be removed from the space, then the lock nut 116 is tightened down with the feeler gauge 120 in place while the adjustment screw 106 is held in place with a screwdriver. This is very difficult to accomplish even for those with experience and especially on the rocker arms 102 located in the back of the 911 engine, such as the rocker arms associated with the Porsche 911 cylinder number six. One 360-degree radial turn of the adjustment screw 106 results in 1 mm of axial travel of the end 110 of the screw. Thus, the traditional factory-recommended valve clearance adjustment process involves ensuring that once the valve clearance gap 108 is set with the feeler gauge 120, the adjustment screw 106 does not move even during the locking down step. This is difficult to achieve even with the engine out of the car, as noted above.

A "backside" method of valve clearance adjustment is also well-described elsewhere, but, for the 911 engine, involves loosening the adjustment screw 106 and then slipping a 0.0025 inch feeler into a space between the camshaft lobe (not illustrated) and the contact surface of the rocker arm at issue. The screw 106 is then tightened down so that the feeler gauge can barely slip out and then the lock nut 116 is tightened down. The "feel" for doing this is subjective. Once the adjustment is locked, if a 0.003 inch feeler gauge cannot fit in the space between the camshaft lobe and the rocker arm contact surface but the 0.0025 inch feeler can, then the space between the swivel foot and valve stem is 0.1 mm. The backside method requires removal of engine shrouding surrounding the engine and some exhaust system components and is very difficult to perform on some hard-to-reach cylinders.

Other less-often used methods of adjusting valve clearance include the use of after-market jigs. While some provide good accuracy, the after-market devices often require time consuming set up and tear down of the jig apparatus for each valve and the set up can be quite difficult when the engine is in the car given cramped space conditions. Also, such jigs are often quite expensive and a require a skilled mechanic who has developed a "touch feel" for locking down the lock nut while holding the adjustment screw in place. Such methods also often require trial and error adjustments until the desired gap is achieved and then confirmed with the measurement indicators on the jig.

The net result of the existing methods of valve clearance adjustment described above, whether on engines with or without pushrods is unsatisfactory. The adjustment is hard to achieve, is often inaccurate, is not always replicable, and is always difficult to perform. As a consequence, some owners spend many hours doing the valve clearance adjustment that is required at least every 15,000 miles on the air cooled 911 engine as normal maintenance. Rechecking and adjustment of the valve clearances is recommended at certain intervals because the valve seat will wear over time and impact the size of the gap at the valve stem 114/adjustment screw 106 interface. Further, the lock nut 116 can loosen and, thus, allow the adjustment screw 106 to move out of the set position. Many owners opt to have a mechanic perform the adjustment at the cost of upwards of $500, and even then the ability of mechanics to achieve the requisite tight tolerances is questionable.

Improperly set valve clearances can damage the engine resulting in thousands of dollars in repair costs and, at the least, cause an otherwise well-engineered and powerful car to perform at less than optimal levels. The need for a reliable, consistent, replicable, easy, and accurate valve clearance adjustment mechanism has long been sought and desired for the 911 engine and any other engine that features a rocker arm and mechanical valve adjustment screw mechanism.

Hydraulic valve lifters, also referred to as hydraulic tappet or lash adjusters, do not have a manually adjustable valve gap and instead include a hydraulic cylinder that maintains the proper positioning between the valve stem and rocker arm or pushrod throughout engine heat-up and cooldown. Such self-adjusting hydraulic operated lifters, however, can be replaced with manually-adjustable solid lifters, in which case the challenges of valve adjustment discussed herein are present. For example, hydraulic valve lifters are sometimes replaced with solid lifters in high performance engines where manually adjustable lifters are more desirable. This is sometimes accomplished by replacing stud mounted rocker arms with shaft mounted rocker arms. Stud mounted rocker arms may also be replaced with shaft mounted rocker arms for the increased strength and durability that may be offered by shaft mounted rocker arms.

SUMMARY OF THE DISCLOSURE

In one implementation, the present disclosure is directed to a valve-clearance setting and adjustment system for adjusting valve gap. The system includes a rocker arm having a first and second end and top and bottom surfaces, the first end defining an elongate opening extending from the top surface to the bottom surface and the first end including a split that extends through a portion of the first end and that defines a clampable gap; an elongate valve adjustment member moveably disposed in the elongate opening, the elongate member having a first end that extends from the top surface of the rocker arm; and a securing mechanism configured to decrease a size of the clampable gap to thereby clamp the valve adjustment member in place in the elongate opening.

In another implementation, the present disclosure is directed to a method of setting a valve gap with a valve clearance setting and adjustment system, the system including a rocker arm that defines an elongate opening and a clampable gap operably coupled to the elongate opening, a valve adjustment screw disposed in the elongate opening, a securing mechanism configured to selectively fix the valve adjustment screw in place in the elongate opening, and an index tool having a plurality of index marks. The method includes rotating the valve adjustment screw in the elongate opening until a first portion of the valve clearance setting and adjustment system contacts a valve stem; positioning the index tool on the valve adjustment screw; rotating the index tool relative to the valve adjustment screw until a first one of the index marks is aligned with a reference mark on the rocker arm; fixing the index tool to the valve adjustment screw; rotating the fixed index tool and valve adjustment screw together until a second one of the index marks is aligned with the reference mark, indicating achievement of a target valve gap; and fixing the valve adjustment screw in place in the elongate opening by decreasing a size of the clampable gap with the securing mechanism.

In yet another implementation, the present disclosure is directed to an index tool for use with a valve-clearance setting and adjustment system. The index tool includes an inner wall that defines an opening configured to receive a valve adjustment screw; a securing mechanism configured to fix the index tool to the valve adjustment screw; and a plurality of index marks spaced by an angular spacing that correlates a degree of rotation of the joined valve adjustment screw and index tool to an axial movement of the valve adjustment screw.

In yet another implementation, the present disclosure is directed to a method of setting a valve gap with a valve clearance setting and adjustment system, the system including a rocker arm that defines an elongate opening and a clampable gap operably coupled to the elongate opening, an elongate valve adjustment member moveably disposed in the elongate opening, and a securing mechanism configured to selectively fix the valve adjustment member in place in the elongate opening. The method incudes placing a feeler gauge between a valve stem and a first portion of the valve clearance setting and adjustment system; adjusting a position of the valve adjustment member relative to the rocker arm until the first portion contacts a first side of the feeler gauge while a second opposite side of the feeler gauge is in contact with the valve stem and a first end of the valve adjustment member extends from a top surface of the rocker arm; and securing the valve adjustment member to the rocker arm with the securing mechanism by reducing a size of the clampable gap.

In yet another implementation, the present disclosure is directed to a valve clearance setting and adjustment system for adjusting valve gap that includes a rocker arm having a first and second end and top and bottom surfaces, at least one of the first and second ends defining an elongate opening extending from the top surface to the bottom surface; a pin slidably disposed in the elongate opening, the pin having a first end configured to contact a pushrod or valve stem; and a securing mechanism configured to selectively fix the pin in place in the elongate opening.

In yet another implementation, the present disclosure is directed to a method of setting a valve gap with a valve clearance setting and adjustment system that includes a rocker arm, a pin slidably disposed in an elongate opening of the rocker arm, and a securing mechanism configured to selectively fix the pin in place in the elongate opening. The method includes placing a feeler gauge between a valve stem and a first portion of the valve clearance setting and adjustment system; sliding the pin through the elongate opening until the first portion contacts a first side of the feeler gauge while a second opposite side of the feeler gauge is in contact with the valve stem; and securing the pin to the rocker arm with the securing mechanism.

In yet another implementation, the present disclosure is directed to a method of setting a valve gap with a valve clearance setting and adjustment system, the system including a rocker arm that has one or more index marks around an elongate opening and a clampable gap operably coupled to the elongate opening, a valve adjustment screw that has one or more reference marks and is disposed in the elongate opening, and a securing mechanism configured to selectively fix the valve adjustment screw in place in the elongate opening by decreasing the size of the clampable gap. The method includes rotating the valve adjustment screw in the elongate opening to a zero gap position, wherein a first portion of the valve clearance setting and adjustment system contacts a valve stem; noting a position of a reference mark on the valve adjustment screw relative to a first reference mark on the rocker arm; rotating the valve adjustment screw until its reference mark is positioned relative to a second index mark on the rocker arm, thereby indicating achievement of a target valve gap; and fixing the valve adjustment screw in place in the elongate opening by decreasing a size of the clampable gap with the securing mechanism.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
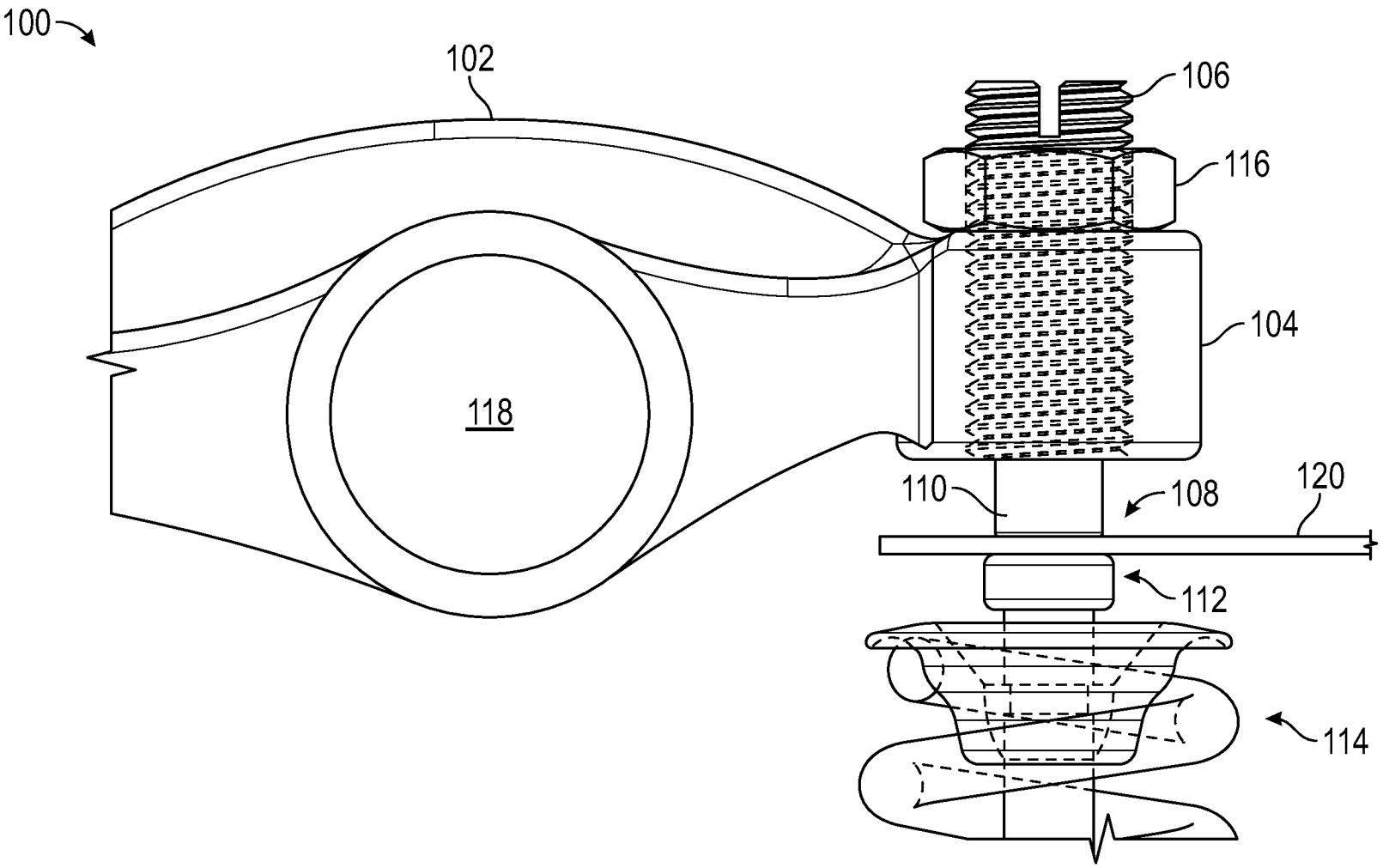
FIG. 1 (Prior Art)
FIG. 1 is a side view of a portion of a prior art direct solid lifter valve train, showing an OEM rocker arm, valve adjustment screw, and valve stem.

The present disclosure generally relates to the field of internal combustion engines. In particular, the present disclosure is directed to, among other things, parts and methods for setting valve clearances, also referred to in the art as "valve gap" or "lash clearances," in rocker arm actuated engine components. Non-limiting examples of rocker arm actuated engine components include the valve clearance setting adjustment systems (also known as "valve gap setting," "tappet setting" or "valve lash setting") that are commonly used with respect to the intake and exhaust valves in the cylinders of internal combustion engines and related methods and may be used to set the clearance between rocker arm actuated engine components.

Aspects of the present disclosure are directed to valve clearance adjustment systems and related methods that can be used to quickly and easily establish and accurately fix a desired and consistent and replicable valve clearance gap in internal combustion engines with shaft mounted rocker arms where a manual valve lash adjustment is required. The disclosure is also directed to providing a means of converting engines that have self-adjusting hydraulic lifters with manually adjustable solid lifters or in engines with stud mounted rocker arms that feature the present systems and methods. In some examples, valve adjustment systems of the present disclosure include valve adjustment members that are slidably disposed in rocker arms and that can be easily and selectively fixed in place in the rocker arm. Aspects of the present disclosure also include rocker arms with split ends that define a clampable gap for quickly and easily adjusting and fixing a valve adjustment member in the rocker arm. Aspects also include indexing mechanisms for quickly setting a desired position of a valve adjustment screw in a rocker arm without needing to use a feeler gauge.

Aspects of the present disclosure can be used to easily establish and adjust desired valve clearance gaps while eliminating much of the guesswork and "feel" required by feeler gauges and the undesirable turning of the valve adjustment screw out of tolerance before and when tightening the lock nut. Parts disclosed herein can be installed, used, and adjusted with the engine in the car or other vehicle or machine, such as a motorcycle, motocross bike, all terrain vehicle, utility vehicle, inboard or outboard motor, or lawnmower engine, etc. By using aspects of the present disclosure, highly accurate, replicable, and expeditious valve clearance settings can be achieved that will not be impacted by adjustment screw and/or lockdown nut slippage and will be consistent across all valves.

At a high level, aspects of the present disclosure are directed to valve clearance adjustment systems and related methods that can be used to quickly, accurately, and easily establish and fix a desired valve clearance gap within an internal combustion engine that have rocker arms and require manual setting of valve gap. Exemplary embodiments illustrating aspects of the present disclosure are described below in the context of specific examples. However, it is emphasized that the embodiments described below are only examples; aspects of the present disclosure can be implemented in any of a number of ways in any of a number of different situations.

In addition to providing a much easier technique for setting a valve gap, valve adjustment systems of the present disclosure also provide for a reduced number of components and the ability to provide lighter-weight components as compared to OEM systems. Reduction of valve train weight without sacrificing strength of components results in a reduction in moment of inertia, thereby reducing the forces needed to move the valve train, resulting in higher revolutions per minute of an engine in less time.

The term "Original Equipment" and the abbreviation OEM, and similar terms, as used herein, refer not only to valve train components and associated parts originally manufactured by an engine manufacturer or originally sourced by an engine manufacturer for inclusion in an engine, but also refers to any aftermarket valve train components conforming to corresponding OEM dimensions and specifications, for example, an aftermarket replacement rocker arm or valve adjustment screw for replacing a rocker arm or valve adjustment screw originally provided in an engine.

Figure 3:
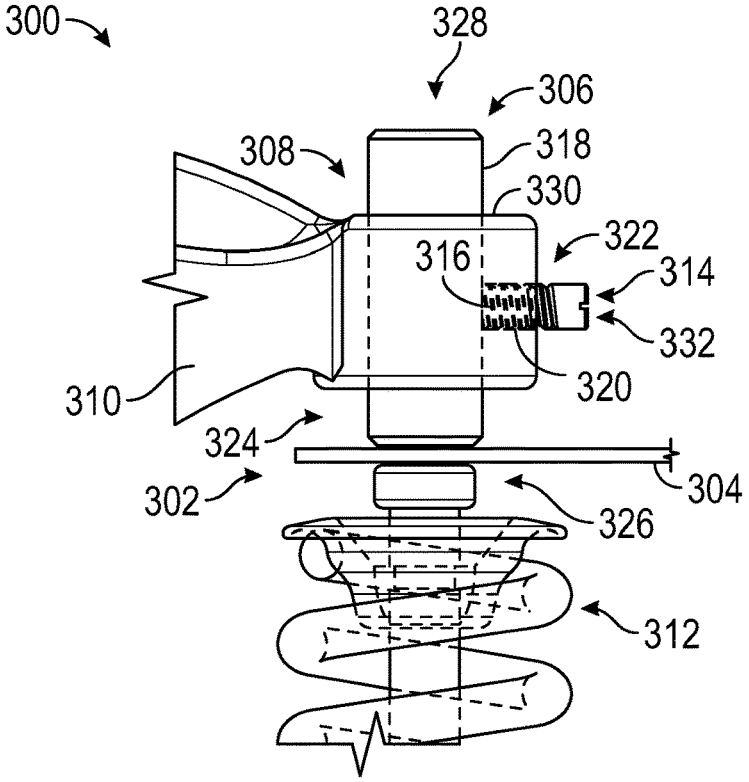
FIG. 3 is a side view of a portion of a valve adjustment system including a valve adjustment member in the form of a pin slidably disposed in a rocker arm as applied to a direct solid lifter valve train.

Referring now to the drawings, FIG. 3 illustrates one example of the present disclosure of a valve adjustment system 300 that can be used to set and adjust a valve gap 302. As shown, a feeler gauge 304 may be positioned in the desired gap 302 where the valve clearance gap is to be established. A valve adjustment member in the form of a slidable pin 306 is slidably inserted in an elongate opening in the form of a bore 308 of a rocker arm 310 and may be positioned such that the feeler gauge 304 is squeezed between a valve stem 312 and the slidable pin 306. FIG. 3 illustrates one example of a direct action solid lifter engine. As will be appreciated, the shim would be slid between the rocker arm and the valve stem in a solid lifter push rod engine (see FIG. 4). A set screw 314 may then be tightened so that an end 316 of the set screw bears against outer surface 318 of the slidable pin 306 to secure it in place within the bore 308. The feeler gauge 304 can then be removed resulting in the setting of the desired valve clearance gap 302.

Accordingly, a system, or assembly of parts, can be provided to enable such a technique, including rocker arm 310 with bore 308 configured and dimensioned to receive slidable pin 306 and a threaded bore 320 located in an end 322 of the rocker arm for set screw 314. In the illustrated example, threaded bore 320 and bore 308 are at right angles, slidable pin 306 being sized and configured to be within bore 308 and set screw 314 sized and configured to screw into the threaded bore 320 and bear against the slidable pin 306 to fix it in position. Slidable pin 306 is conceptually illustrated in FIG. 3 as a smooth-walled cylinder, however, outer surface 318 of the pin and/or end 316 of set screw 314 may have any of a variety of features to facilitate securing the pin in the rocker arm bore 308 with the set screw. For example, outer surface 318 and/or end 316 may be textured, knurled, and/or have grooves and/or ridges.

Thus, in an embodiment for a direct action solid lifter engine as depicted in FIG. 3 rocker arm 310 may be provided that does not have a threaded bore to accommodate prior art valve adjustment screw 106 (FIG. 1) but rather includes an elongate opening having a wall that may be smoothed, textured, etc. that defines a bore 308 in substantially the same location where the prior art threaded bore would normally be located.

Bore 308 is sized to accommodate slidably installed non-threaded elongate adjustment member in the form of slidable pin 306 having a longitudinal axis and disposed in the rocker arm bore 308 and configured for relative movement with respect to the rocker arm 310 in a direction parallel to the longitudinal axis of the slidable pin 306. In the direct action solid lifter engine configuration shown in FIG. 3, end 324 of pin 306 is configured to bear against end 326 of valve stem 312 at the point on the valve stem where prior art valve adjustment screw 106 (FIG. 1) would normally be positioned. A second end 328 of slidable pin 306 protrudes from a top surface 330 of rocker arm 310 by a sufficient amount that the second end of the pin may be held with fingertips, for example, a protrusion of approximately one to two inches from top surface 330. In the illustrated example, threaded bore 320 is located in rocker arm 310 at a right angle to bore 308 and slidable pin 306, the threaded bore sized to accommodate a securing mechanism, in the illustrated example, set screw 314, for fixing the elongate slidable pin 306 in the rocker arm bore 308 to prevent relative movement therebetween. In other examples, a threaded bore to accommodate set screw 314 may be positioned in any of a variety of locations in the rocker arm depending on the type of engine and need for easy accessibility. In some examples, a wall of the bore and/or an outer surface of pin 306 includes a scored or textured surface configured to increase a coefficient of friction between the pin and bore. In some examples, bore 308 has a non-circular shape configured to increase a coefficient of friction between the pin and bore.

When the slidable pin 306 has been installed in bore 308 and set screw 314 tightened within threaded bore 320, end 316 of the set screw bears against slidable pin 306 with sufficient force to hold it in position. Head 332 of set screw 314 may be recessed into the body of rocker arm 310 and may be equipped to receive and be tightened or loosened with a variety of well knows means such as Torx, hex head, Allen or other drivers. Recessing the head 332 may reduce valve train weight. End 316 of set screw 314 may have a variety of shapes and may swivel on the end of the set screw 314 or be immovably fixed to the set screw. One or more of rocker arm bore 308, slidable pin 306, and end 316 of the set screw 314 may be wedged, scored or knurled or shaped or deformed or deformable or otherwise configured to provide a maximum amount of friction or a geometric alignment and coupling to securely fix pin 306 in bore 308. For example, in one example slidable pin 306 may be configured to be sufficiently secured so that even if end 324 of the slidable pin were to be forcefully repeatedly tapped against valve stem 312 or repeatedly moved by a push rod as a result of 310 rocker arm rocking back and forth, the slidable pin 306 would remain immovably fixed in position within the rocker arm. For example, the slidable pin 306 may have a flat or slightly angular surface 318, at least in a longitudinal area proximate where end 316 of set screw 314 and the end of the set screw may also may have a flat or angular surface to increase the contact surface area or provide geometric friction through slight misalignment between the slidable pin 306 and the set screw. Alternatively or in addition, slidable pin 306 and bore 308 may be non-circular, such as hex or star shaped to provide additional surface area for contact with a complementarily shaped end 316 of set screw 314. In some examples, rather than a single set screw 314, valve adjustment system 300 may include two or more set screws in each rocker arm 310, the set screws located in various locations to ensure slidable pin 306 is securely locked in place in the rocker arm 310.

In one example, a method of setting valve gap 302 with valve adjustment system 300 may include positioning a camshaft as required for the particular engine, inserting a suitably sized feeler gauge 304 in the position where the desired valve clearance gap is to be established. Sliding slidable pin 306 through rocker arm bore 308 until end 324 of the slidable pin rests against the feeler gauge and squeezes the feeler gauge between the slidable pin 306 and the valve stem 312 with modest pressure. Next, the method may include holding slidable pin 306 against feeler gauge 304 while tightening set screw 314 until end 316 of the set screw firmly engages outer surface 318 of slidable pin 306. Removing feeler gauge 304 by sliding it out of the gap 302 establishes the resulting valve clearance gap.

As will be appreciated, one benefit of a slidable pin is avoidance of possible inaccuracies due to inadvertent and unwanted turning of the prior art valve adjustment screw 106 before or during installation of a securing mechanism such as prior art lock nut 116.

Figure 4:
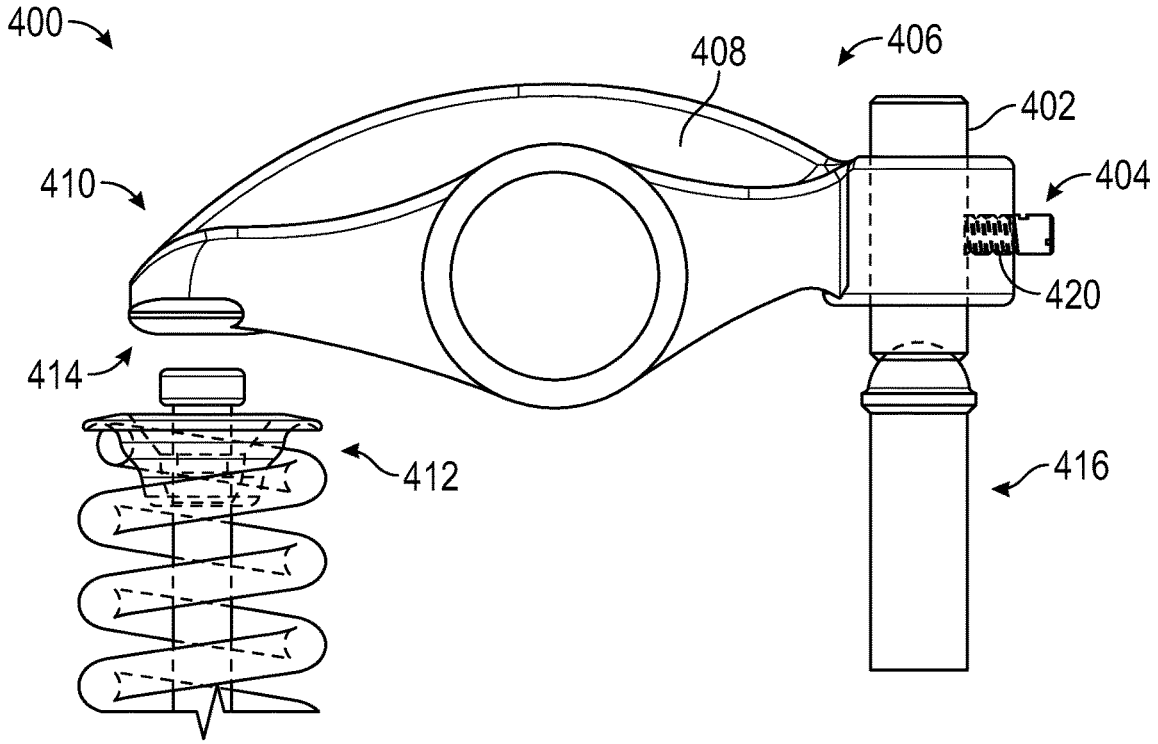
FIG. 4 is a side view of a portion of a valve adjustment system including a valve adjustment member in the form of a pin slidably disposed in a rocker arm as applied to a pushrod solid lifter valve train.

FIG. 4 illustrates a valve adjustment system 400 that has a similar configuration to valve adjustment system 300 (FIG. 3) as applied to a solid lifter push rod engine. As shown, a slidable pin 402 and a set screw 404, the set screw located in a threaded bore 420, are placed in a pushrod end 406 of a rocker arm 408, which is on an end of the rocker arm opposite from a first end 410 of the rocker arm that pushes valve stem 412 open and where a valve clearance gap 414 is measured. In one example, a method of adjusting valve clearance gap 414 may be essentially the same as the method described above for adjusting valve clearance gap 302 (FIG. 3) and modified only by the user pushing modestly down on first end 410 of rocker arm 408 so as to squeeze a feeler gauge between the first end of the rocker arm and valve stem 412. At that point, and ensuring that the slidable pin 402 is also pressing against push rod 416, set screw 404 may be tightened to secure slidable pin 402 in position and thereby establish the required valve clearance gap 414 once the feeler gauge is removed.

In one example, prior art OEM rocker arm 102 (FIG. 1) or 202 (FIG. 2) may be modified to receive a securable slidable pin 306 or 402. For example, a threaded bore may be formed in an end of the OEM rocker arm, thereby forming threaded bore 320, 420 for receipt of set screw 314, 404, and valve adjustment screw 106, 206 may be replaced with slidable pin 306, 402. The rocker arm valve adjustment screw threaded bore may be reamed to remove the threading, or can be kept in OEM form, in which case an outer diameter of the slidable pin may be substantially the same as a major diameter of the rocker arm valve adjustment screw threaded bore. In yet other examples, the OEM valve adjustment screw 106, 206 may continue to be used, but may be secured with set screw 314, 404 with or without the OEM lock nut 116, 216.

Figure 2:
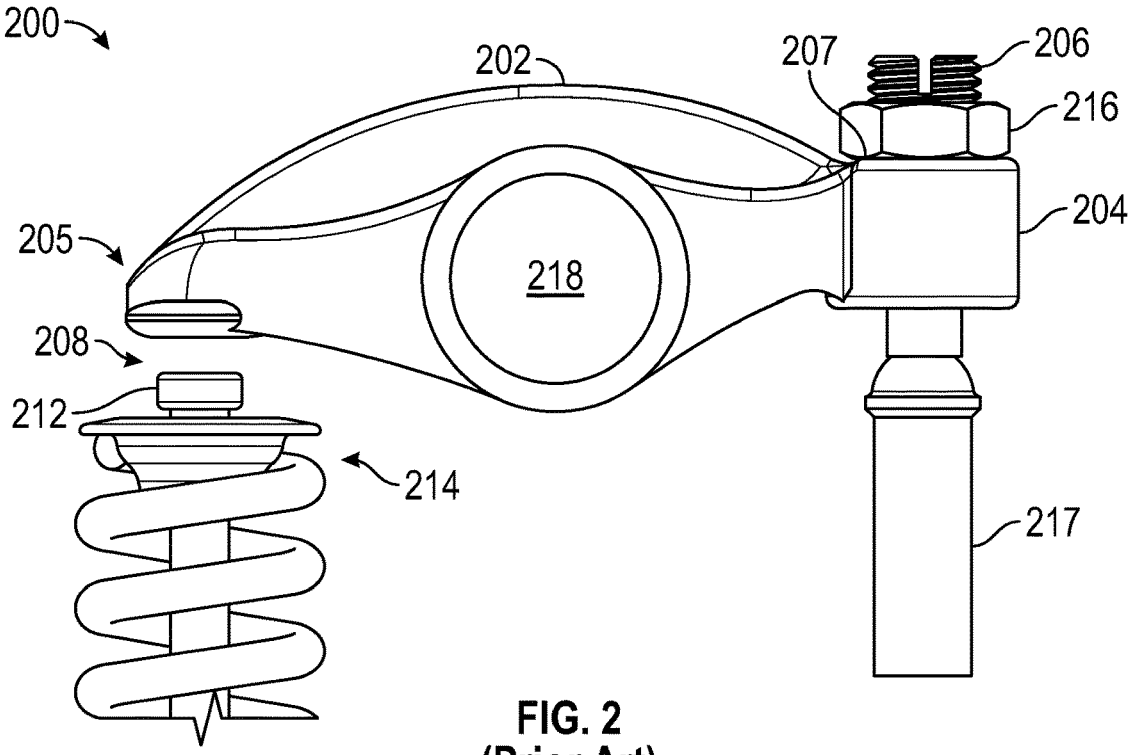
FIG. 2 (Prior Art)
FIG. 2 is a side view of a portion of a prior art pushrod solid lifter valve train, showing an OEM rocker arm, valve adjustment screw, valve stem, and pushrod.
Figure 5:
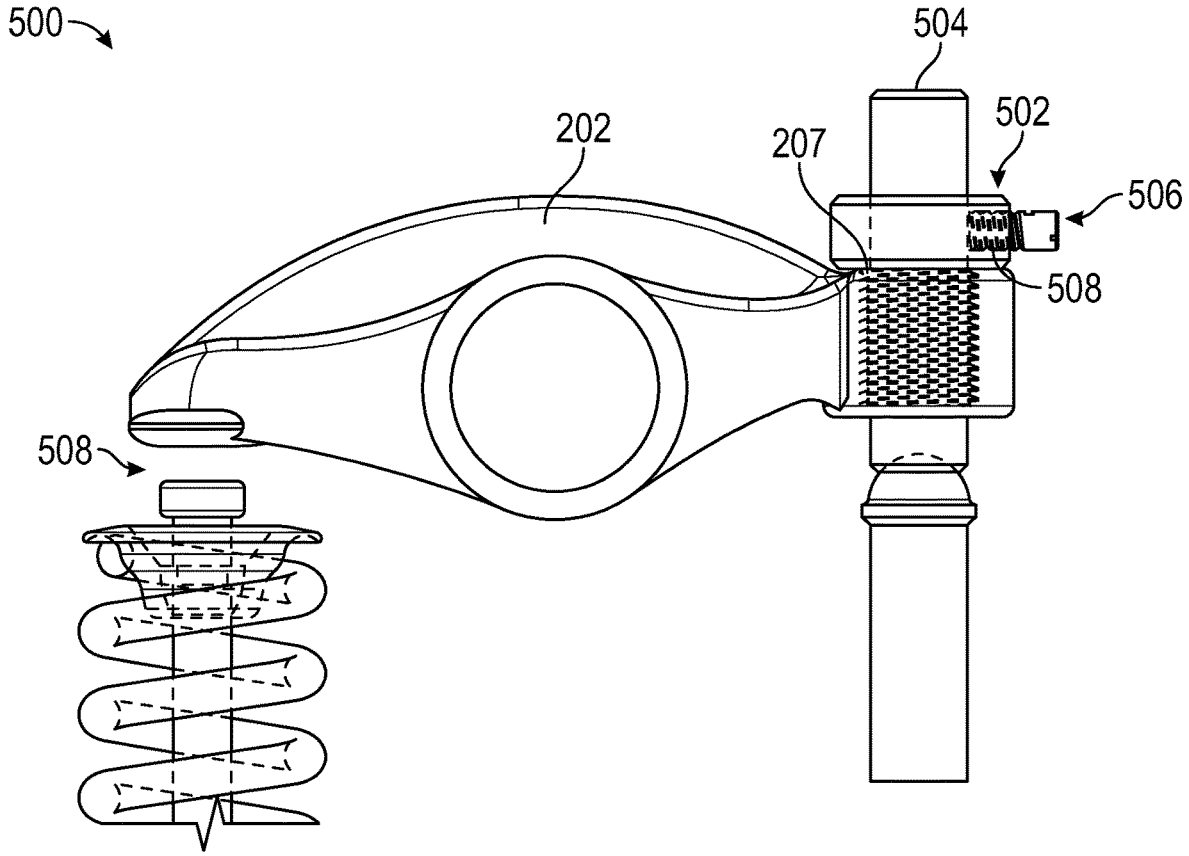
FIG. 5 is a side view of a portion of a valve adjustment system including a valve adjustment member in the form of a pin slidably disposed in a threaded insert disposed in a rocker arm as applied to a pushrod solid lifter valve train.
Figure 6:
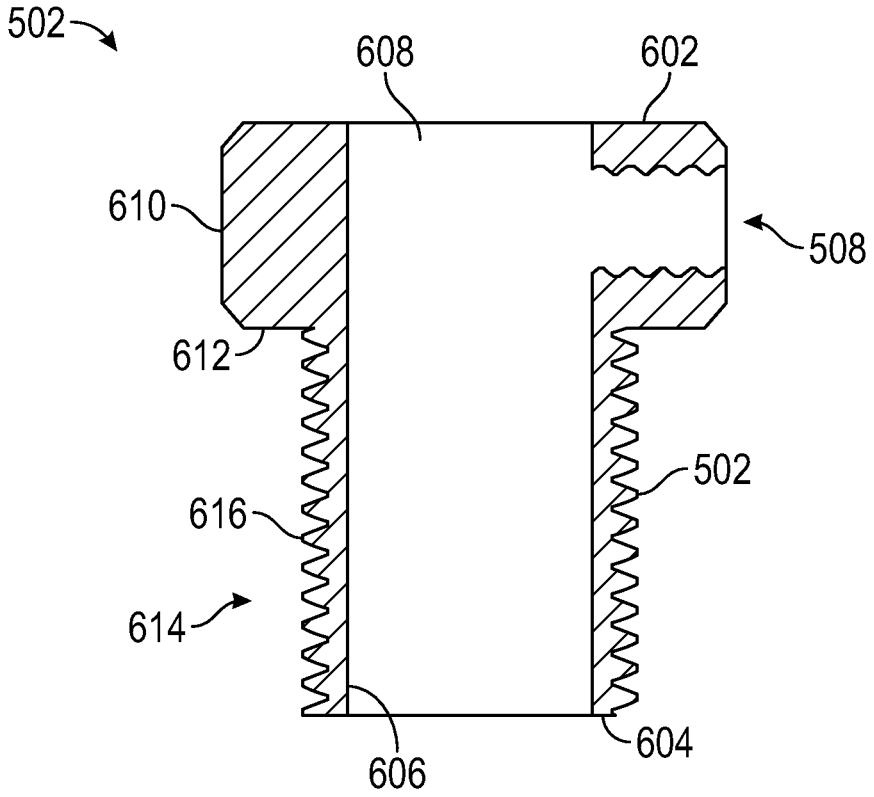
FIG. 6 is a cross sectional view of the threaded insert of FIG. 5.

FIGS. 5 and 6 illustrate an example valve adjustment system 500 made in accordance with the present disclosure that is similar to adjustment systems 300 and 400 and includes a threaded insert 502 and slidable pin 504 configured to be installed in prior art rocker arm 202 (see also FIG. 2). Threaded insert 502 is configured to replace valve adjustment screw 206 and be threaded into the valve adjustment screw rocker arm bore 207 and receive slidable pin 504. A securing mechanism, e.g., set screw 506 disposed in a threaded bore 508 of the insert 502 can be tightened to secure the slidable pin in the insert. Thus, adjustment system 500 can be used to quickly and easily modify prior art valve adjustment system 200 (FIG. 2) by replacing valve adjustment screw 206 and lock nut 216 with threaded insert 502, slidable pin 504, and set screw 506. FIG. 5 shows valve adjustment system 500 as applied to a pushrod solid lifter configuration. As will be appreciated, substantially the same assembly, including threaded insert 502, slidable pin 504, and set screw 506 can be used with a direct action solid lifter configuration (e.g., FIG. 1) by replacing valve adjustment screw 106 and lock nut 116 with an appropriately sized threaded insert 502, slidable pin 504, and set screw 506.

FIG. 6 shows a cross sectional view of threaded insert 502. In the illustrated example, threaded insert 502 includes a first end 602 and second end 604 and an inner wall 606 that defines an elongate opening 608 that extends from the first to the second end. Opening 608 is configured and dimensioned to receive slidable pin 504. Threaded insert 502 includes a first portion 610 that defines a shoulder 612 configured to come into contact with a top surface of rocker arm 202 and a second portion 614 that includes a threaded outer wall 616 configured to be threaded into rocker arm valve adjustment screw threaded bore 207 (FIG. 2, 5). Threaded bore 508 is configured to receive set screw 506 and extends perpendicularly to a central longitudinal axis of elongate opening 608 from an outer wall of first portion 610 to the central longitudinal axis.

Figure 7A:
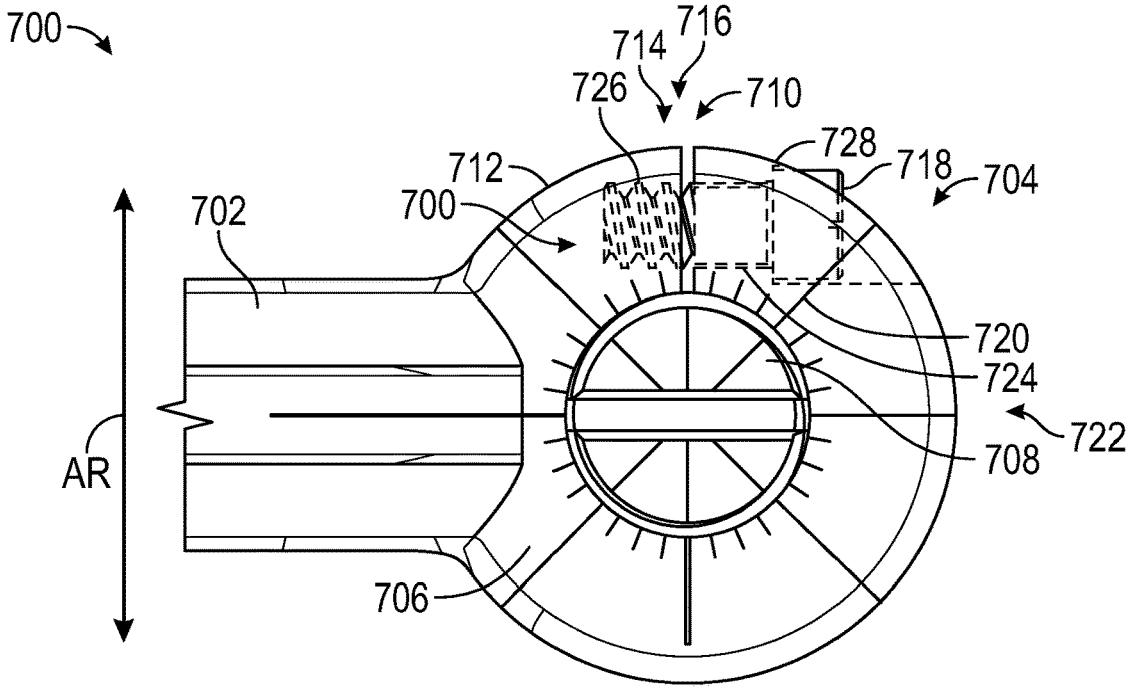
FIG. 7A is a top view of a portion of a valve adjustment system including a rocker arm with a split end and index marks and a valve adjustment screw with reference marks, the valve adjustment screw in a zero gap position.
Figure 7B:
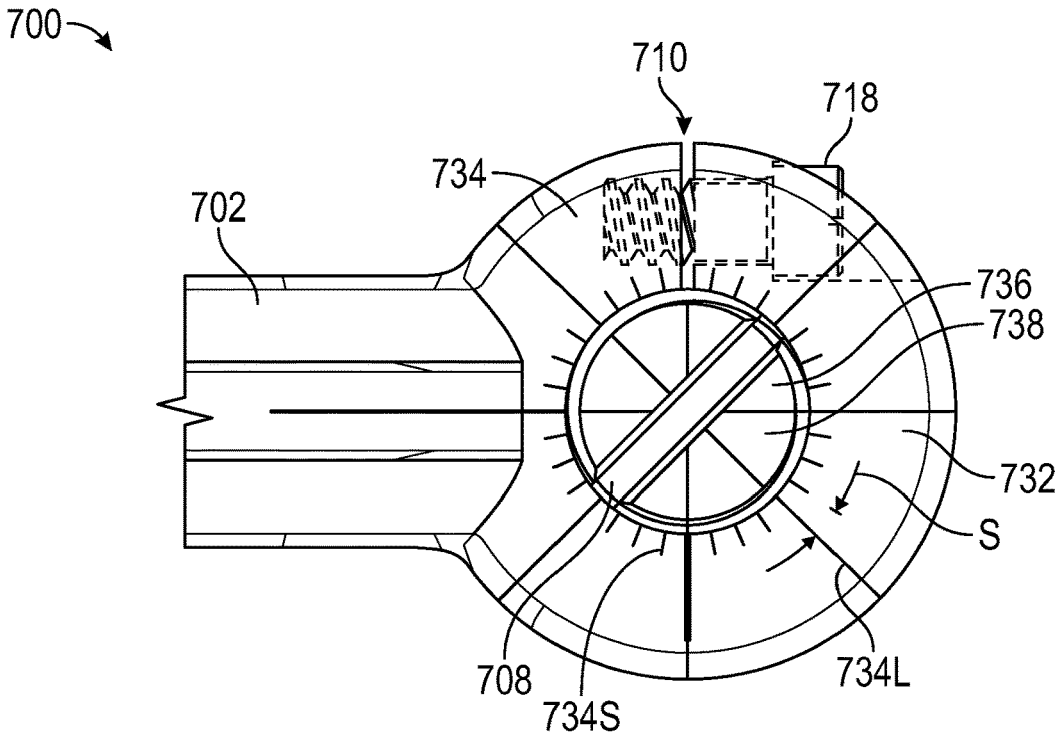
FIG. 7B is a top view of the valve adjustment system of FIG. 7A showing the valve adjustment screw rotated to a target valve gap position.
Figure 7C:
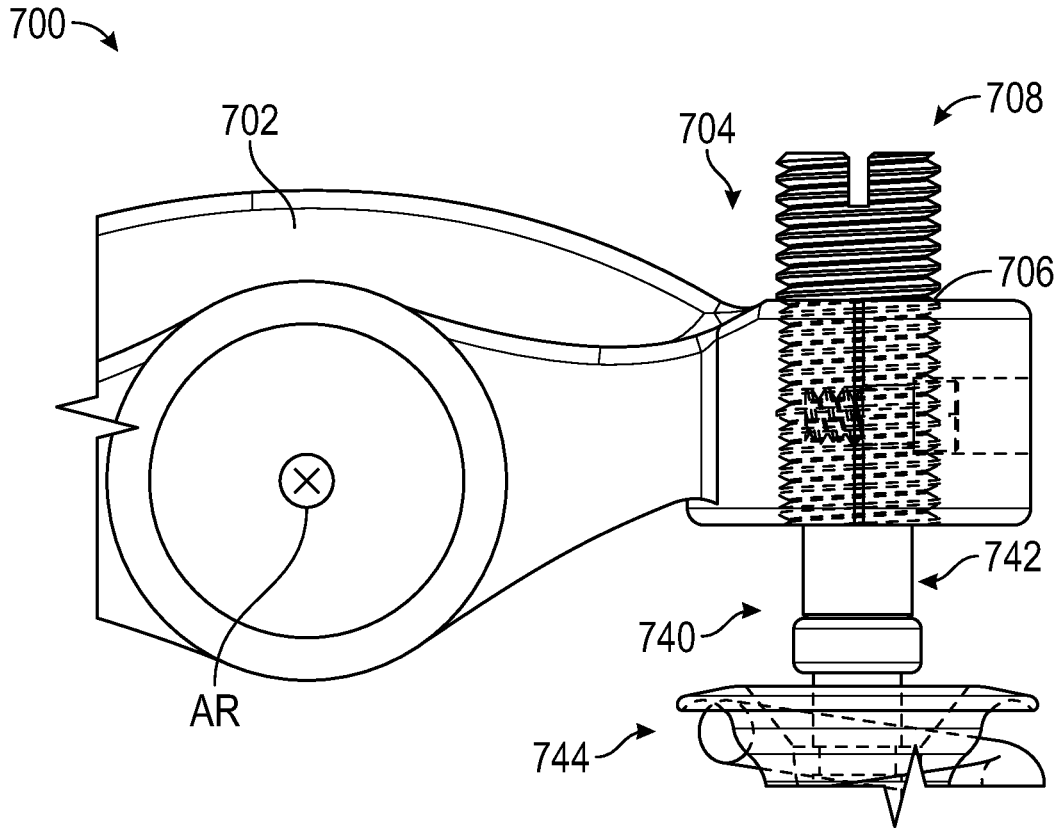
FIG. 7C is a side view of the valve adjustment system of FIGS. 7A and 7B showing the valve adjustment screw in the zero gap position.

FIGS. 7A-7C illustrate another example valve adjustment system 700 made in accordance with the present disclosure. Valve adjustment system 700 includes a rocker arm 702 that includes a first end 704 that includes a threaded bore 706 configured to receive a valve adjustment screw 708. In the illustrated example, first end 704 includes a split 710 that extends fully through and bisects a portion of the first end from an outer wall 712 to threaded bore 706 to thereby define a clampable gap 714 for securing valve adjustment screw 708 in the threaded bore. In the illustrated example, split 710 is on a first side 716 of the rocker arm and is a vertical split oriented substantially perpendicularly to an axis of rotation, AR, of rocker arm 702 and substantially parallel to a central longitudinal axis of valve adjustment screw 708.

Rocker arm 702 also includes a clamping screw 718 disposed in a threaded bore 720, the clamping screw configured to pull split 710 closed to close gap 714 to secure valve adjustment screw 708 in place. Bore 720 extends from an end 722 of rocker arm 702 and is substantially perpendicular to rocker arm axis of rotation, AR, and the central longitudinal axis of valve adjustment screw 708. Bore 720 includes a first portion 724 located on a first side of gap 714 that has a smooth inner wall and a second portion 726 located on a second side of the gap that has a threaded inner bore. First portion 724 defines a shoulder 728 configured to engage a complementary shoulder of clamping screw 718. The illustrated split 710 and clamping screw 718 allows for the elimination of OEM lock nut 116 to fix the valve adjustment screw in place. As described more below, by eliminating the OEM lock nut 116 and opening up the space above top surface 732 of rocker arm 702, various tools and techniques may be incorporated for quickly and easily setting a desired valve gap that enable the elimination of the use of a feeler gauge.

FIGS. 7A and 7B are top views of rocker arm 702 and illustrate, on a top surface 732, of the rocker arm, radially extending rocker arm index marks 734 scribed in the top surface. In the illustrated example, rocker arm index marks 734 include long index marks 734L (only one labeled) located every 45 degrees and shorter index marks 734S (only one labeled) equally spaced between the long index parks. A top surface 736 of valve adjustment screw 708 includes radially extending valve adjustment screw reference marks 738 for easily tracking a rotational position of the adjustment screw relative to the rocker arm. Index marks 734 can be configured and dimensioned to have an angular spacing, S, that corresponds to a predetermined change in size of valve gap 740 when valve adjustment screw 708 is rotated, where the angular spacing-valve gap relationship is a function of a thread pitch of valve adjustment screw 708.

Referring to FIG. 7C, counterclockwise rotation of valve adjustment screw 708 will raise end 742 of the adjustment screw in an axial direction creating a gap 740 between the adjustment screw end and valve stem 744 (or in the case of a push rod solid lifter engine, between the valve stem and rocker arm end), where the change in gap size per degree of rotation is a function of the thread pitch of the valve adjustment screw. By way of example, in the Porsche 911 engine, the OEM valve adjustment screw 106 (FIG. 1) has a pitch of 1.0 mm. Thus, a full 360 degree rotation of valve adjustment screw 106 will cause a 1.0 mm axial movement of the adjustment screw. To achieve the Porsche 911 recommended valve gap 108 of 0.10 mm between valve stem 114 and valve adjustment screw 106, the valve adjustment screw should be rotated 1/10 of 360 degrees, or 36 degrees from a zero gap position. Thus, for the Porsche 911, a target valve adjustment screw rotation, R, for achieving a desired valve gap, G, is 36 degrees. In one example, angular spacing, S, of rocker arm index marks 734 is equal to R or a smaller value that R is evenly divisible. Thus, in the Porsche 911 example, S may be 36 degrees, or 36 divided by a natural number, e.g., 18 degrees, 12 degrees, etc. A user can therefore determine an axial movement of valve adjustment screw 708 by noting a position of a first reference mark 738 relative to a first one of index marks 734 and then rotating the adjustment screw R degrees until the first reference mark 738 is aligned with a second index mark 734 that has an angular spacing of R from the first index mark.

In one example, a method of setting a desired valve gap 740 (FIG. 7C) with valve adjustment system 400 includes rotating valve adjustment screw 708 in a clockwise direction until there is zero gap 740 between end 742 of the adjustment screw and valve stem 744 as shown in FIG. 7C (or in the case of a push rod solid lifter engine a zero gap between an end of the valve adjustment screw and push rod). FIG. 7A is a top view of the zero gap position shown in FIG. 7C. A user can then note a position of valve adjustment screw reference marks 738 relative to rocker arm index marks 734 and then rotate valve adjustment screw 708 in a counterclockwise direction, for example, to the position shown in FIG. 7B, to thereby increase a size of valve gap 740 until valve adjustment screw reference marks 738 reach a desired new rocker arm index mark 734, thereby indicating a desired valve gap 740 has been achieved. In the example illustrated in FIGS. 7A and 7B, the target valve adjustment screw rotation, R, for achieving a desired valve gap, G, is 45 degrees. Long index marks 734L have an angular spacing equal to R and spacing S between each index mark 734 is R/4, or 11.25 degrees. After achieving the position shown in FIG. 7B, a user can tighten clamping screw 718 to squeeze split 710 together to lock valve adjustment screw 708 in place.

In another example method of adjusting valve gap 740 using valve adjustment system 400, a user can use a feeler gauge (similar to feeler gauge 120 (FIG. 1)) having a thickness equal to a desired valve gap instead of or in addition to using valve adjustment screw reference marks 738 and rocker arm index marks 734. Valve adjustment screw 708 can be rotated in a clockwise direction until both end 742 of the valve adjustment screw and valve stem 744 come into contact with the feeler gauge, indicting a desired valve gap 740 has been achieved. A user can then tighten clamping screw 718 to squeeze split 710 together to lock valve adjustment screw 708 in place.

FIGS. 8A-8D illustrate an example valve adjustment system 800 made in accordance with the present disclosure, which has many of the same features as valve adjustment system 700 (FIG. 7), including a rocker arm 802 that includes a first end 804 that includes a threaded bore 806 configured to receive a valve adjustment screw 808. A first end 804 of the rocker arm includes a split 810 that extends fully through and bisects a portion of the first end from an outer wall to threaded bore 806 to thereby define a clampable gap 814 for securing valve adjustment screw 808 in threaded bore 806. As with system 700, split 810 is on a first side of the rocker arm and is a vertical split oriented substantially perpendicularly to an axis of rotation, AR, of rocker arm 802 and substantially parallel to a central longitudinal axis of valve adjustment screw 808. Rocker arm 802 also includes a clamping screw 818 disposed in a threaded bore 820, the clamping screw configured to pull split 810 closed to close gap 814 to secure valve adjustment screw 808 in place.

Figure 8A:
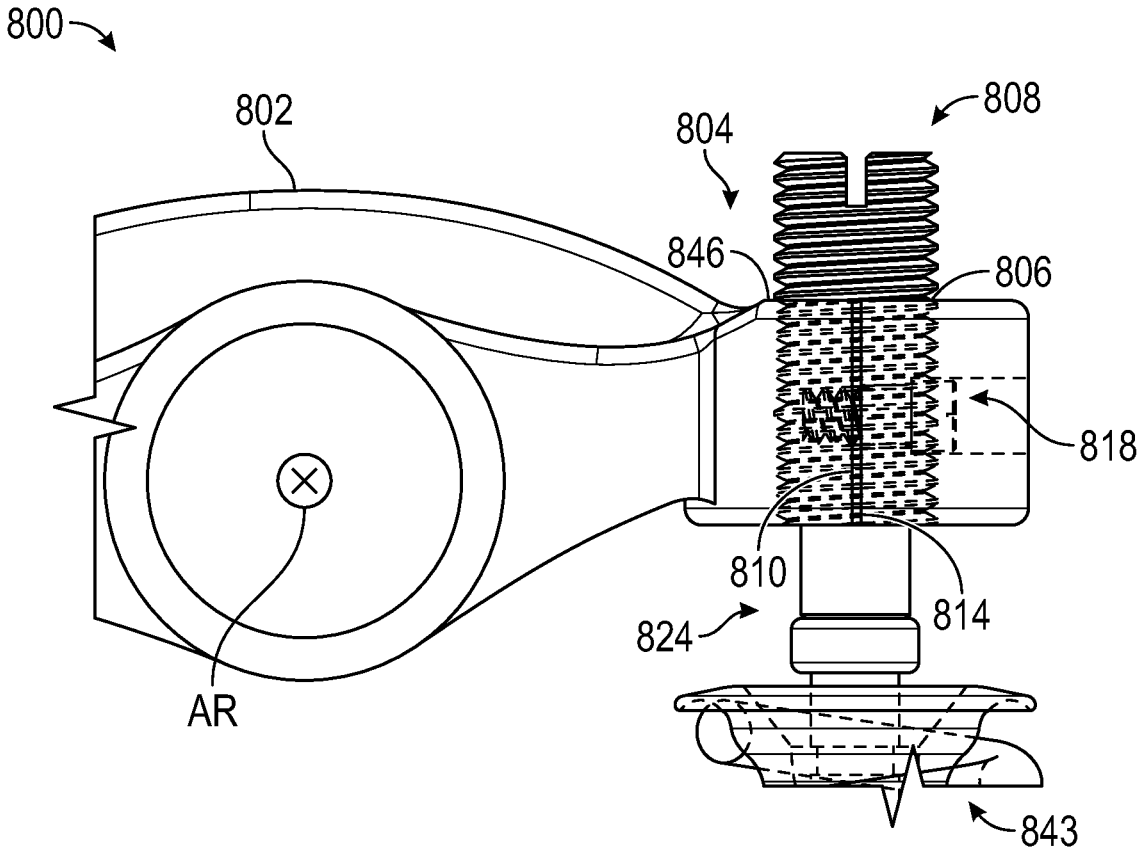
FIG. 8A is a side view of a valve adjustment system including a rocker arm with a split end.
Figure 8B:
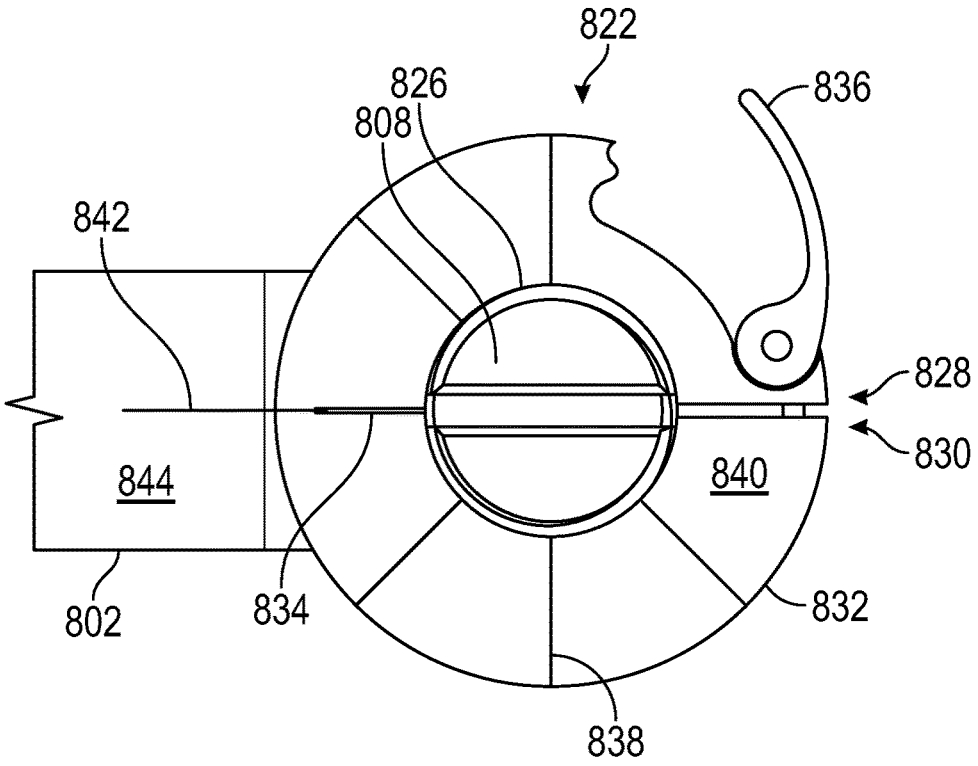
FIG. 8B is a top view of a portion of the valve adjustment system of FIG. 8B, also showing an index tool disposed on the valve adjustment screw, the index tool rotatably coupled to the valve adjustment screw and the valve adjustment screw in a zero gap position.
Figure 8C:
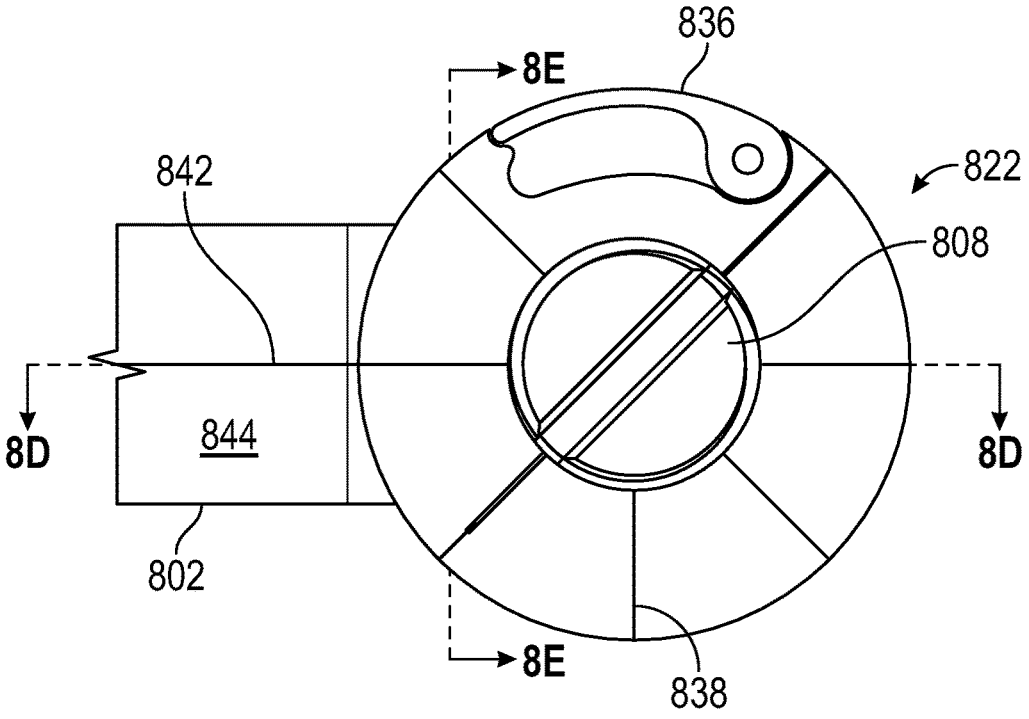
FIG. 8C is a top view of the valve adjustment system of FIGS. 8A and 8B, the index tool clamped on to the valve adjustment screw, and the index tool and valve adjustment screw rotated to a target valve gap position.

FIG. 8B is a top view of system 800 and also illustrates an index tool 822 that has been positioned on valve adjustment screw 808 for setting a desired valve gap 824 (FIG. 8A). In the illustrated example, index tool 822 has an annular shape including a threaded inner wall 826 configured and dimensioned to be threaded onto valve adjustment screw 808. Index tool 822 is in the form of a clamp and includes a first split 828 that defines a clampable gap 830 that bisects a portion of the index tool extending from an outer wall 832 to inner wall 826 and a second split 834 located opposite first split 828 and that extends partially into inner wall 826. Index tool 822 includes a lever 836 that is rotatably disposed on the index tool and configured to reduce a size of clampable gap 830 when moved from an open position, as shown in FIG. 8B, to a closed position, as shown in FIG. 8C, to thereby reduce a diameter defined by inner wall 826 and secure index tool 822 to valve adjustment screw 808. Index tool 822 also includes index marks 838 (only one labeled) on a top surface 840 of the index tool that are configured to be aligned with a stationary reference mark 842 in a top surface 844 of rocker arm 802.

In the illustrated example, index tool 822 includes seven index marks 838 that are equally spaced by an angular spacing, S, of 45 degrees. Index tool may include more or less index marks having greater or smaller angular spacing. For example, the removable nature of index tool 822 allows for a plurality of index tools with each tool having a unique number of index marks 838 and/or angular spacing of the index marks that correspond to a particular valve adjustment screw thread pitch and/or specified valve gap for a particular engine.

Figure 8D:
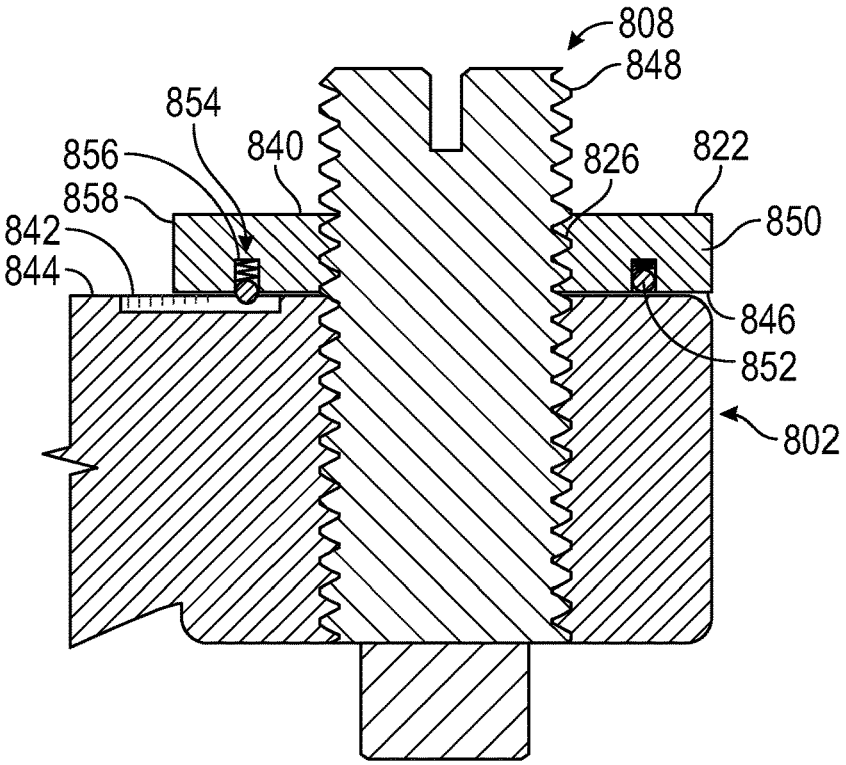
FIG. 8D is a side cross sectional view of the valve adjustment system of FIGS. 8A-8C.
Figure 8E:
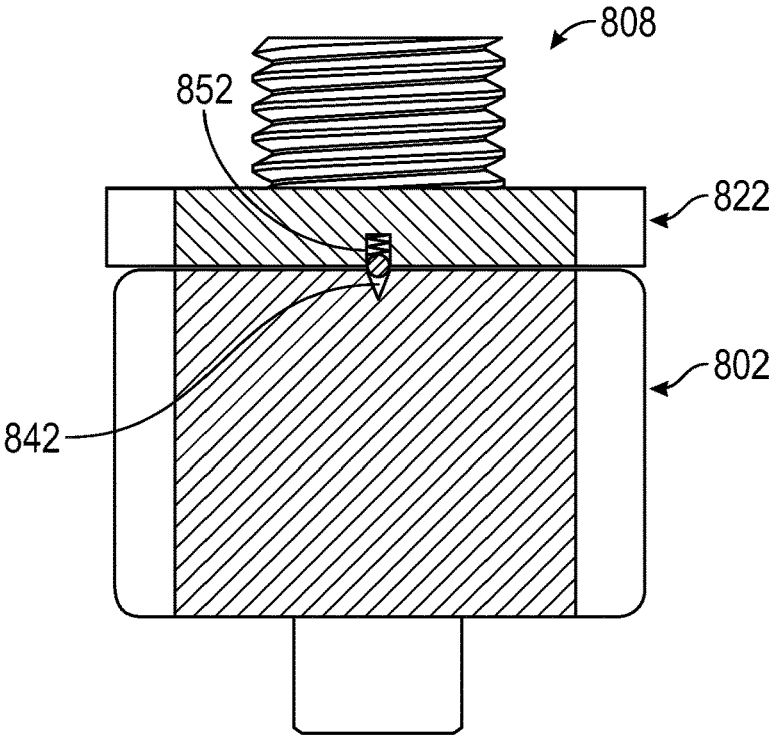
FIG. 8E is another side cross sectional view of the valve adjustment system of FIGS. 8A-8D.

FIGS. 8D and 8E are cross sectional views of valve adjustment system 800 and show index tool 822 threaded onto valve adjustment screw until a bottom surface 846 of the index tool is in close proximity to, for example, has almost come into contact with or has come into contact with top surface 844 of rocker arm 802. As shown in FIGS. 8D and 8E, in the illustrated example, top surface 840 and bottom surface 846 of the index tool are substantially flat and parallel. In the illustrated example, inner wall 826 includes threads that are configured to mate with threads 848 of valve adjustment screw 808. In other examples, inner wall 826 may be smooth or textured rather than threaded such that index tool would be slid over valve adjustment screw 808 rather than threaded onto the valve adjustment screw. In the illustrated example, index tool 822 includes a detent 850 for providing a tactile feedback to a user as the user rotates the index tool on the rocker arm surface 844 to aid in aligning index tool index marks 838 with rocker arm reference mark 842. In the illustrated example, detent 850 includes a plurality of circumferentially spaced balls 852 that are each resiliently biased within a corresponding recesses 854 located in bottom surface 846, each ball resiliently biased with a corresponding spring 856 located in each of the recesses.

Reference mark 842 located in top surface 844 of rocker arm 802 is in the form of an elongate channel and is configured, dimensioned, and located such that the reference mark overlaps outer wall 858 of the index tool such that a portion of the reference mark protrudes from the index tool and is visible to a user to aid in visual alignment of the index marks 838 and the reference mark. A second portion of reference mark 842 extends radially inward of balls 852 so that the balls will engage the reference mark by extending down into the channel defined by the reference mark. As best seen in FIG. 8E, reference mark 842 has a v-shaped cross section and a width at top surface 844 that is approximately the same as an outer diameter of balls 852. Index tool 822 can have any number of balls 852 located in any of a variety of patterns and relative spacing. In the illustrated example, index tool 822 includes the same number of balls as the number of index marks 838, with one ball aligned with each of the index marks, such that when an index mark becomes aligned with reference mark 842, one of balls 852 will extend into and engage the reference mark, creating a slight resistance to turning and providing a tactile and audible feedback to the user indicating an index mark is aligned with the reference mark. In other examples, other detent mechanisms may be used in addition to or instead of detent 850, such as a spring loaded ratchet and pawl mechanism located within index tool 822 and/or a magnetic detent including a plurality of discrete magnetic elements within the index tool and/or rocker arm for creating discrete arresting forces as tactile feedback of alignment.

The illustrated combination of a split end rocker arm 802 and index tool 822 provides for a highly accurate and simple to use valve adjustment system 800 and also results in a lighter-weight configuration as compared to OEM system 100 by eliminating OEM lock nut 116 previously required to fix valve adjustment screw 808 in place. The elimination of weight on the valve train of an engine is desirable because reduction of weight reduces a moment of inertia of the valve train thereby reducing an amount of force required to move the valve train and thus, allowing for faster achievement of engine revolutions per minute and horsepower output.

In one example, a method of setting a valve clearance gap with valve adjustment system 800 includes rotating valve adjustment screw 808 in a clockwise direction until an end of the valve adjustment screw makes contact with valve stem 844 as shown in FIG. 8A, such that there is no valve gap, also referred to herein as a zero gap position. Index tool 822 can then be positioned on a portion of valve adjustment screw 808 that extends above a top surface 844 of rocker arm 802. In the illustrated example this may be done by screwing indexing tool 822 onto valve adjustment screw 808 in a clockwise direction until bottom surface 846 of the index tool is in close proximity to top surface 844 of rocker arm 802 such that an alignment of reference point 842 and index reference 838 is achieved while the valve adjustment screw is in the zero gap position. If one of index marks 838 is not aligned with reference mark 842 when index tool 822 is almost or fully threaded onto valve adjustment screw 808, the user can then rotate in either a clockwise or counterclockwise direction until one of the index marks is aligned with the reference mark, and detent 850 provides a tactile or audible feedback indicating the alignment. In alternate examples where the index tool is slid onto the valve adjustment screw rather than threaded on, the index tool is simply slid down the valve adjustment screw until it makes contact with the rocker arm and then rotated in clockwise or counterclockwise until one of the index tool index marks is aligned with the rocker arm reference mark.

With index tool 822 positioned on valve adjustment screw 808 in close proximity with rocker arm 802 and one of index marks 838 aligned with reference mark 842 and/or the tactile or audible signal illustrated in FIGS. 8D and 8E indicate alignment in the zero gap position, the index tool is then fixed to the valve adjustment screw, in the illustrated example, by closing lever 836 to clamp the index tool to the valve adjustment screw to non-rotatably couple the index tool and valve adjustment screw together. In other examples, additional or alternate securing mechanisms for securing the index tool to the valve adjustment screw may be used, such as set screws, pins, and/or magnetic engagement. The combined index tool 822 and valve adjustment screw 808 can then be rotated counterclockwise, thereby increasing valve gap 824 until a target index mark 838 becomes aligned with reference mark 842, thereby indicating the target valve gap has been achieved. As shown in FIGS. 8D and 8E, achieving the target valve gap can also be indicated by tactile or audible signal when one of balls 852 falls into the groove defined by reference mark 842, thereby indicating an index mark 838 is aligned with the reference mark. In some examples, the target index mark will be the next index mark immediately adjacent the starting index mark that was aligned with reference mark 842 at the zero gap position while in other examples, the target index mark may be two or more index marks from the zero gap index mark.

The counterclockwise rotation of the immovably combined index tool 822 and valve adjustment screw 808 will raise the end of the adjustment screw in an axial direction creating a gap between the valve adjustment screw and valve stem 843 (or in the case of a push rod solid lifter engine, between the valve stem 843 and rocker arm end) in accordance with the pitch of the threads of the valve adjustment screw and the extent of the counterclockwise rotation of the adjustment screw and index tool combination. For example, as noted above, in the Porsche 911 engine, the valve adjustment screw has a pitch of 1.0 mm. Thus, a full 360 degree rotation of the valve adjustment screw will cause a 1.0 mm axial movement of the adjustment screw. To achieve the Porsche 911 recommended valve gap of 0.10 mm between the valve stem and the valve adjustment screw, the combined adjustment screw 808 and index tool 822 would be rotated 1/10 of 360 degrees, or 36 degrees from the zero gap position. Thus, the index tool 822 that is designed and configured for user with the Porsche 911 engine would include at least two index marks spaced by 36 degrees, or index marks spaced by an angular spacing that is evenly divisible into 36 degrees, and in some cases, the index tool may include index marks spaced around its perimeter as shown in FIGS. 8B and 8C. By first lining up any one of the index lines 838 on the index tool 822 with the fixed reference mark 842 on rocker arm 802 before immovably affixing the index tool to the adjustment screw using the clamping mechanism shown in FIGS. 8B and 8C, and then rotating the combined indexing tool and adjustment screw counterclockwise 36 degrees or to the next index mark on the index tool, the end of the adjustment screw will gap 0.10 mm away from the valve stem. At that point, when the desired valve gap has been established, clamping screw 818 (FIG. 8A) in the split end 804 of the rocker arm can be tightened to squeeze the rocker arm end around the valve adjustment screw and lock the valve adjustment screw in place in the rocker arm. Index tool 822 can then be unclamped and removed from adjustment screw 808 for use in another valve adjustment.

Figure 9:
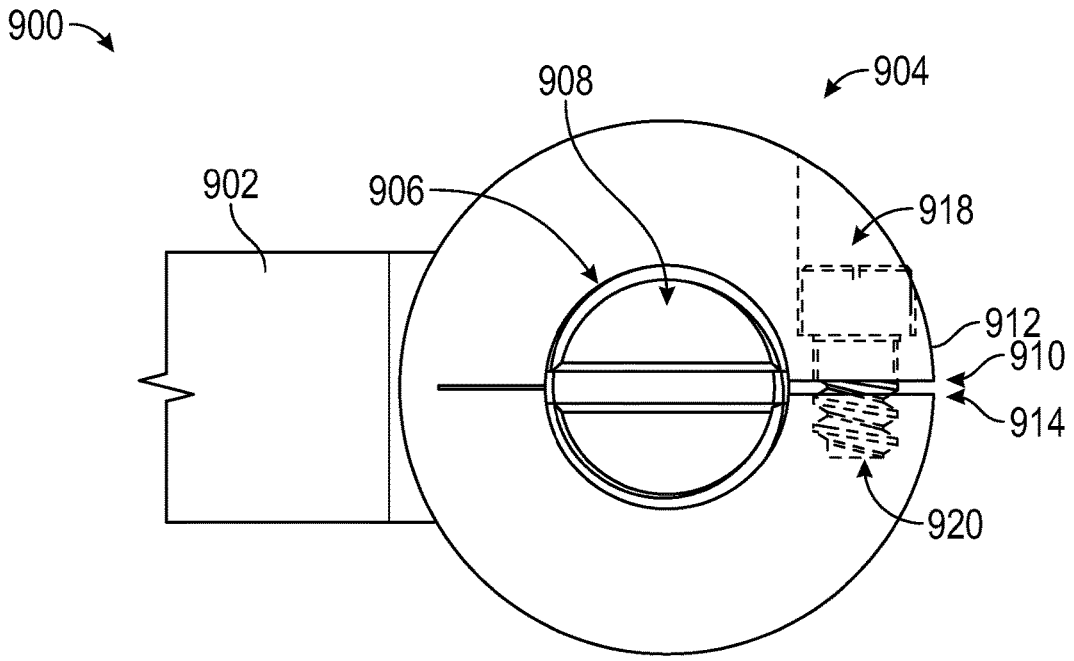
FIG. 9 is a top view of a valve adjustment system including a rocker arm with a split end, the split being a vertical split located in an end of the rocker arm.

FIG. 9 illustrates an example valve adjustment system 900 made in accordance with the present disclosure that is similar to valve adjustment systems 700 (FIGS. 7A-7C) and 800 (FIGS. 8A-8E). Valve adjustment system 900 includes a rocker arm 902 that includes a first end 904 that includes a threaded bore 906 configured to receive a valve adjustment screw 908. First end 904 of the rocker arm includes a split 910 that extends fully through and bisects a portion of the first end from an outer wall 912 to threaded bore 906 to thereby define a clampable gap 914 for securing valve adjustment screw 908 in threaded bore 906. Unlike valve adjustment systems 700 and 800, split 910 is on an end of the rocker arm rather than a first or second opposing side. Similar to valve adjustment systems 700 and 800, split 910 is a vertical split oriented substantially perpendicularly to an axis of rotation of rocker arm 902 and substantially parallel to a central longitudinal axis of valve adjustment screw 908. Rocker arm 902 also includes a clamping screw 918 disposed in a threaded bore 920, the threaded bore having a longitudinal axis that is substantially parallel to an axis of rotation of the rocker arm and substantially perpendicular to a longitudinal axis of valve adjustment screw 908. Clamping screw 918 is configured to pull split 910 closed to close gap 914 to secure valve adjustment screw 908 in place. Valve adjustment system 900 may include an indexing system similar to valve adjustment system 700, including valve adjustment screw index marks similar to reference marks 738 and rocker arm index marks 734, and/or an indexing system similar to valve adjustment system 800, including an index tool similar to index tool 822 and rocker arm reference mark similar to reference mark 842.

Figure 10:
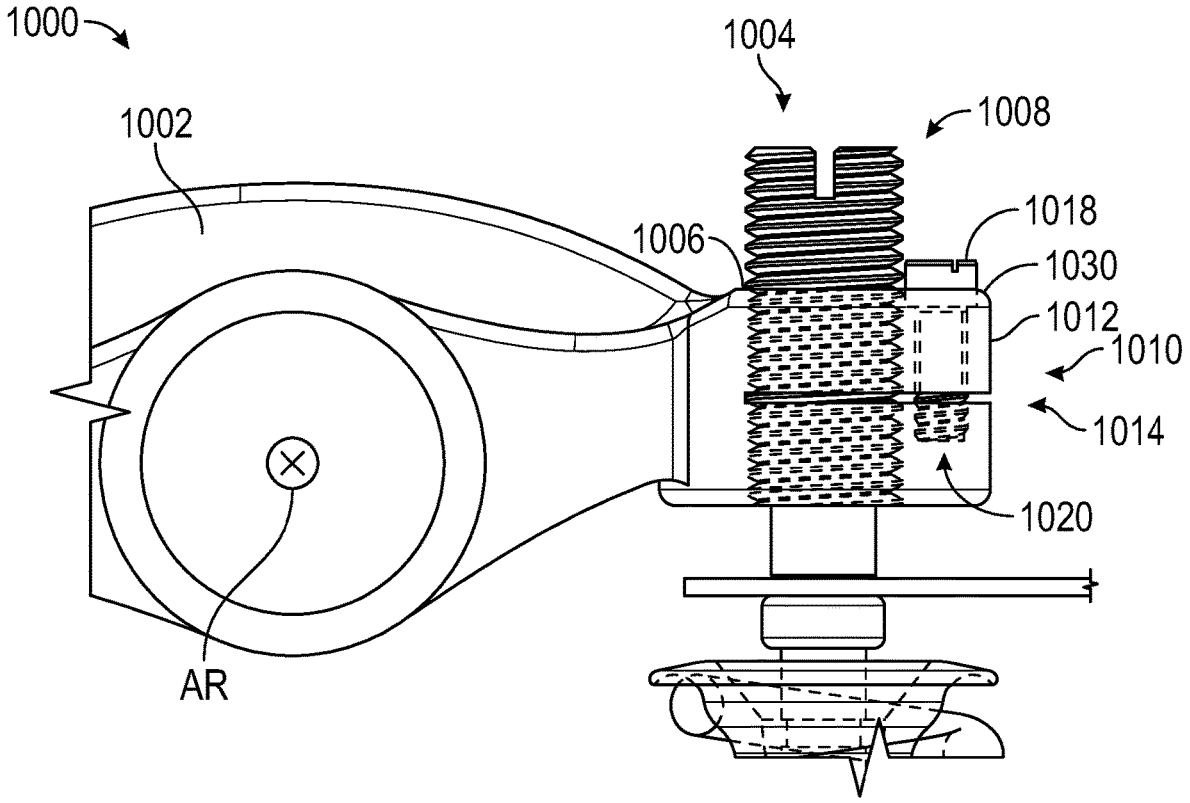
FIG. 10 is a side view of a valve adjustment system including a rocker arm with a split end, the split being a horizontal split located in an end of the rocker arm.

FIG. 10 illustrates an example valve adjustment system 1000 made in accordance with the present disclosure that is similar to valve adjustment systems 700 (FIGS. 7A-7C), 800 (FIGS. 8A-8E) and 900 (FIG. 9). Valve adjustment system 1000 includes a rocker arm 1002 that includes a first end 1004 that includes a threaded bore 1006 configured to receive a valve adjustment screw 1008. First end 1004 of the rocker arm includes a split 1010 that extends fully through and bisects a portion of the first end from an outer wall 1012 to threaded bore 1006 to thereby define a clampable gap 1014 for securing valve adjustment screw 1008 in threaded bore 1006. Split 1010 is on an end of the rocker arm and is a horizontal split oriented substantially parallel to an axis of rotation AR of rocker arm 1002 and substantially perpendicular to a central longitudinal axis of valve adjustment screw 1008. Rocker arm 1002 also includes a clamping screw 1018 disposed in a threaded bore 1020, the threaded bore having a longitudinal axis that is substantially perpendicular to an axis of rotation AR of the rocker arm and substantially parallel to a longitudinal axis of valve adjustment screw 1008. Claiming screw threaded bore 1020 is located in a top surface 1030 of rocker arm 1002 and has a vertical orientation, clamping screw 1018 being configured to pull split 1010 closed to close gap 1014 to secure valve adjustment screw 1008 in place. Valve adjustment system 900 may include an indexing system similar to valve adjustment system 700, including valve adjustment screw index marks similar to reference marks 738 and rocker arm index marks 734, and/or an indexing system similar to valve adjustment system 800, including an index tool similar to index tool 822 and rocker arm reference mark similar to reference mark 842.

In other examples, a rocker arm with a clampable gap, such as illustrated in valve adjustment systems 700, 800, 900, and/or 1000 may be modified to include a valve adjustment member in the form of a slidable pin slidably disposed in the rocker arm, similar to the slidable pin of valve adjustment systems 300, 400, and 500, rather than a valve adjustment screw. In such examples, the clampable gap may be reduced to clamp the slidable pin in place in the rocker arm after a target valve gap is achieved. Valve adjustment systems disclosed herein may be constructed by modifying OEM rocker arms or by replacing a OEM rocker arm with a replacement rocker arm that includes features disclosed herein. By way of example, a clampable gap, such as illustrated in valve adjustment systems 700, 800, 900, and/or 1000 may be machined into an OEM rocker arm or an OEM rocker arm may be replaced with a replacement rocker arm that includes a clampable gap.

Various parts and techniques described herein can be designed to fit or retrofit existing rocker arms and/or used in newly manufactured rocker arms that have been manufactured to accommodate the implementation of one or more aspects of the present disclosure. This implementation allows for easy and accurate setting of valve clearances to factory specification without the need for readjustment due to slippage with the use of prior art OEM valve adjustment screws and lock nuts. By providing a substitute and/or replacement for the existing valve adjustment screws and lock nuts now used, the cumbersome, difficult, and inaccurate current procedures and tools presently used to adjust valves on these types of engines can be eliminated. The disclosure is also directed to provide a means of converting engines that have self-adjusting hydraulic lifters with manually adjustable lifters and/or replacement of stud mounted rocker arms with shaft mounted rocker arms that feature the present systems and methods.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of the disclosure. Features of each of the various embodiments described above may be combined with features of other described embodiments as appropriate in order to provide a multiplicity of feature combinations in associated new embodiments. For example, examples of valve adjustment systems applied to direct action solid lifter configurations may be readily modified to be applied to pushrod solid lifter configurations and vice versa. Further, while direct action and pushrod solid lifter configurations have been illustrated, persons having ordinary skill in the art can apply the teachings of the present disclosure to other valve train configurations. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

What is claimed is:

1. A valve-clearance setting and adjustment system for adjusting valve gap, the system comprising:

a rocker arm including a first and second end and top and bottom surfaces, the first end defining an elongate opening extending from the top surface to the bottom surface, and a split that extends through a portion of the first end that defines a clampable gap;

an elongate valve adjustment member moveably disposed in the elongate opening; and a securing mechanism configured to decrease a size of the clampable gap to clamp the elongate valve adjustment member in place in the elongate opening.

2. The system of claim 1, wherein the split is a vertical split or a horizontal split.

3. The system of claim 1, wherein the securing mechanism is a screw, a bolt or a clamp operably coupled to the first end of the rocker arm.

4. The system of claim 1, wherein the elongate valve adjustment member is a valve adjustment screw, the system further comprising an index tool configured to be disposed on a portion of the valve adjustment screw extending from the top surface of the rocker arm, the index tool including a plurality of index marks having an angular spacing that corresponds to a thread pitch of the valve adjustment screw.

5. The system of claim 4, wherein the index tool includes a securing mechanism configured to fix the index tool to the valve adjustment screw.

6. The system of claim 5, wherein the securing mechanism of the index tool is a clamp or set screw.

7. A method of setting a valve gap with a valve clearance setting and adjustment system, the system including a rocker arm that defines an elongate opening and a clampable gap operably coupled to the elongate opening, a valve adjustment screw disposed in the elongate opening, a securing mechanism configured to selectively fix the valve adjustment screw in place in the elongate opening, and an index tool having a plurality of index marks, the method comprising:

rotating the valve adjustment screw in the elongate opening until a first portion of the valve clearance setting and adjustment system contacts a valve stem;

positioning the index tool on the valve adjustment screw;

rotating the index tool relative to the valve adjustment screw until a first index mark of the plurality of index marks is aligned with a reference mark of the system;

fixing the index tool to the valve adjustment screw;

rotating the fixed index tool and valve adjustment screw together until a second index mark of the plurality of index marks is aligned with the reference mark, indicating achievement of a target valve gap; and fixing the valve adjustment screw in place in the elongate opening by decreasing a size of the clampable gap with the securing mechanism.

8. The method of claim 7, wherein the first and second index marks are spaced by an angular spacing that corresponds to the target valve gap and a thread pitch of the valve adjustment screw.

9. The method of claim 7, wherein the rocker arm has first and second ends, the elongate opening located in the first end of the rocker arm, wherein the first portion is an end of the valve adjustment screw or the second end of the rocker arm.

10. An index tool for use with a valve-clearance setting and adjustment system, the index tool comprising:

an inner wall that defines an opening configured to receive a valve adjustment screw;

a fastener or clamp configured to transition between a first position in which the index tool is enabled to rotate relative to the valve adjustment screw, and a second position in which the index tool is fixed to an outer surface of the valve adjustment screw; and a plurality of index marks spaced by an angular spacing that correlates a degree of rotation of the valve adjustment screw to an axial movement of the valve adjustment screw;

wherein the plurality of index marks are on an outer surface of the index tool and provide a visual alignment of the plurality of index marks with respect to a reference mark of the system, wherein rotation of the valve adjustment screw when the fastener or clamp is in the second position results in a joint rotation of the index tool with the valve adjustment screw such that a relative movement between the plurality of index marks and the reference mark provides an indication of an amount of the axial movement of the valve adjustment screw.

11. The index tool of claim 10, wherein the plurality of index marks are spaced by an angular spacing that corresponds to a target valve clearance gap.

12. The index tool of claim 10, wherein the inner wall is threaded, the index tool configured to be threaded onto the valve adjustment screw.

13. The index tool of claim 10, further comprising a means to provide tactile and/or audible feedback when a first index mark of the plurality of index marks is aligned with a reference mark on a rocker arm.

14. The index tool of claim 13, further comprising a bottom surface configured to face a top surface of the rocker arm, the means including a plurality of resiliently biased balls respectively disposed in a corresponding plurality of circumferentially spaced recesses located in the bottom surface of the index tool.

15. A system, comprising:

the index tool of claim 10; and a rocker arm including a first and second end and top and bottom surfaces, the first end defining an elongate opening extending from the top surface to the bottom surface, and a split that extends through a portion of the first end that defines a clampable gap;

wherein the elongate opening is configured to receive the valve adjustment screw and a size of the clampable gap is configured to be adjustable to secure the valve adjustment screw in place in the elongate opening.

16. A valve clearance setting and adjustment system for adjusting valve gap, the system comprising:

a rocker arm including a first and second end and top and bottom surfaces, at least one of the first and second ends defining an elongate opening extending from the top surface to the bottom surface;

a pin slidably disposed in the elongate opening, the pin including a first end configured to contact a pushrod or valve stem; and a securing mechanism configured to selectively fix the pin in place in the elongate opening;

wherein at least one of a wall of the elongate opening or an outer wall of the pin includes a scored or textured surface configured to increase a coefficient of friction between the pin and the elongate opening.

17. The system of claim 16, wherein the securing mechanism includes a threaded set screw or bolt disposed in a threaded bore, wherein the threaded bore is perpendicular to and intersects the elongate opening to allow an end of the set screw or bolt to make contact with the pin to secure the pin in place in the elongate opening.

18. The system of claim 16, wherein the elongate opening has a non-circular shape configured to increase a coefficient of friction between the pin and the elongate opening.

19. The system of claim 16, wherein the pin has a shape configured to increase a coefficient of friction between the pin and the elongate opening.

20. The system of claim 16, further comprising a threaded insert that includes a threaded outer wall and an inner wall that defines the elongate opening, and wherein the rocker arm further includes a threaded bore, the threaded outer wall configured to be threaded into the threaded bore.

* * * * *